US010953958B2

(12) United States Patent
Nalitchaev

(10) Patent No.: US 10,953,958 B2
(45) Date of Patent: Mar. 23, 2021

(54) METHOD OF INCREASING THE STABILITY OF A SURFER ON A SURFBOARD, SURFBOARD (VARIANTS) AND DEVICE FOR INCREASING THE STABILITY OF A SURFER ON A SURFBOARD

(71) Applicant: Ilia Borisovitch Nalitchaev, Moscow (RU)

(72) Inventor: Ilia Borisovitch Nalitchaev, Moscow (RU)

( * ) Notice: Subject to any disclaimer, the term of this patent is extended or adjusted under 35 U.S.C. 154(b) by 188 days.

(21) Appl. No.: 16/325,033

(22) PCT Filed: Aug. 15, 2016

(86) PCT No.: PCT/RU2016/000548
§ 371 (c)(1),
(2) Date: Feb. 12, 2019

(87) PCT Pub. No.: WO2018/034582
PCT Pub. Date: Feb. 22, 2018

(65) Prior Publication Data
US 2020/0223515 A1 Jul. 16, 2020

(51) Int. Cl.
*B63B 32/66* (2020.01)
*B63B 32/40* (2020.01)

(52) U.S. Cl.
CPC ..... *B63B 32/66* (2020.02); *B63B 32/45* (2020.02)

(58) Field of Classification Search
CPC ..... B63B 32/66; B63B 32/45
See application file for complete search history.

(56) References Cited

U.S. PATENT DOCUMENTS 4,767,370 A * 8/1988 Campbell ..... B63B 32/50 441/74
6,192,817 B1 * 2/2001 Dec ..... F02B 61/045 114/55.56

(Continued)

FOREIGN PATENT DOCUMENTS

FR 2837164 9/2003
FR 2915457 10/2008

(Continued)

*Primary Examiner* — S. Joseph Morano
*Assistant Examiner* — Jovon E Hayes
(74) *Attorney, Agent, or Firm* — Aleksandr Smushkovich

(57) ABSTRACT

A device is proposed, increasing stability of a surfer on a surfboard. It includes an anchoring means connected to the surfboard, in turn, including a negative pressure chamber, a receiving chamber, its nozzle, and an outlet pipe. At least one surfer's foot is anchored by the anchoring means to the surfboard, when it's in motion, by a suction flow formed in water by the negative pressure chamber. The suction flow is conveyed via the pipe to the point where the foot contacts with the surfboard, so that the foot is adhered thereto by negative pressure. The device's first embodiment further includes a fin disposed on the underside rear part of the surfboard, while the anchoring means is disposed inside or on the fin. A second embodiment envisages the anchoring means disposed in a depression made in the underside. The depression is open at the surfboard's bottom, forming a channel.

20 Claims, 2 Drawing Sheets

(56) References Cited

U.S. PATENT DOCUMENTS

| | | | | |
|---|---|---|---|---|
| 6,702,634 | B2 * | 3/2004 | Jung | B63B 32/10 441/74 |
| 9,359,044 | B2 * | 6/2016 | Langelaan | B63B 32/60 |
| 9,701,372 | B2 * | 7/2017 | Railey | B63H 5/16 |
| 9,718,528 | B2 * | 8/2017 | Railey | B63H 21/12 |
| 10,118,677 | B2 * | 11/2018 | Zapata | B63B 32/10 |
| 10,683,075 | B2 * | 6/2020 | Schibli | B63J 99/00 |
| 2020/0223515 | A1 * | 7/2020 | Nalitchaev | B63B 32/45 |

FOREIGN PATENT DOCUMENTS

| | | |
|---|---|---|
| RU | 2104898 | 2/1998 |
| WO | WO2010148470 | 12/2010 |

* cited by examiner

METHOD OF INCREASING THE STABILITY OF A SURFER ON A SURFBOARD, SURFBOARD (VARIANTS) AND DEVICE FOR INCREASING THE STABILITY OF A SURFER ON A SURFBOARD

CROSS-REFERENCE TO RELATED APPLICATIONS

This application is a U.S. national stage application of a PCT application PCT/RU2016/000548 filed on 15 Aug. 2016, published as WO/2018/034582, whose disclosure is incorporated herein in its entirety by reference.

FIELD OF INVENTION

The technical solutions relate to floating transportation means, in particular, to surfboards. They solve a problem of improving stability of surfer's position on a surfboard during movement of the surfboard across a water surface.

BACKGROUND OF THE INVENTION

There is a known surfboard comprising a body having top channels for passing water streams, wherein the channels are provided symmetrically relative to a longitudinal axis of the surfboard and comprise an inlet funnel in an upper part of the surfboard and an outlet funnel in a lower part of the surfboard (application DE3320331A1, 13 Dec. 1984). These channels solve a problem of improving stability of the surfboard and surfer's position on the surfboard, owing to stabilization of the surfboard by oncoming water streams during movement of the surfboard and by forcing the surfboard and the surfer located thereon to an aqueous medium.

There is a surfboard known from patent documentation, the surfboard comprising a body made of several layers of a special porous resilient material having air channels along the body, connected to an indicator of air pressure in the body (application WO2011009621A, 27 Jan. 2011). The surfboard is equipped with a means for improving stability of surfer's position on the surfboard, providing control, reading and visual indication of pressure inside the surfboard. This solution allows a surfer to adjust speed to ensure a necessary rigidity of the surfboard and improve stability of the surfer's position on the surfboard.

According to application WO2011009621A, the surfboard comprises a body, at least one fin located in a rear portion of a lower side of the body, and a locking means connected to the surfboard for securing at least one surfer's foot to the surfboard.

Design of such a surfboard predetermines a method of improving stability of surfer's position on the surfboard, the method consisting in securing surfer's foot or feet to the surfboard in contact spots of the surfboard by means of providing roughness of a surface of the surfboard to improve traction between the surfer's soles and the surfboard.

Design of known surfboards does not ensure full securing surfer's feet to the surfboards to avoid longitudinal displacement thereof relative a surface of the surfboard, which effect considerably reduces stability of surfer's position on the known surfboards.

There is a known surfboard equipped with locking means for securing surfer's feet to the surfboard in a form of arched collars connected to sliders able to move in slideways along a surface of the surfboard. The sliders may have a spacer providing a constant minimal distance between two foot lockers (application FR2837164A1, 19 Sep. 2003). This surfboard restricts freedom of surfer's movement over a surface of the surfboard. Moreover, the locking means in a form of collars are not safe enough, so the foot may drop out of the collar during movement or performing tricks.

BRIEF SUMMARY OF THE INVENTION

A technical result of the invention is improving stability of surfer's position on the surfboard, while maintaining a great freedom of surfer's movement on a surface of the surfboard and providing a necessary level of safety.

The technical result is obtained by a method of improving stability of surfer's position on the surfboard, the method consisting in securing at least one surfer's foot to the surfboard by a locking means in a spot of contact between the foot and the surfboard, wherein securing the foot to the surfboard is provided by suction, (herein also called underpressure), caused by movement of the surfboard. In order to provide that, a suction stream is formed in water by a suction chamber (herein also called a low-pressure chamber), and the stream is fed to a spot of contact between the foot and the surfboard via a pipe, so the foot is forced to the surfboard by the underpressure.

The technical result is obtained by a surfboard comprising a body having a fin located in a rear portion of a lower side of the body, and a locking means for securing at least one surfer's foot to a surface of the surfboard. The locking means comprises a suction chamber (herein also called a low-pressure chamber); an input chamber; an input chamber nozzle; and an output pipe connected sequentially to and located on the fin or inside the fin. The nozzle is installed in the output pipe with a gap, and the low-pressure chamber is hermetically connected to a wall of the input chamber and a wall of the output pipe. The low-pressure chamber communicates with at least one opening provided in the surface of the surfboard by a suction pipe connected to the low-pressure chamber, to provide interaction with the surfer's foot.

In another embodiment, the surfboard comprising a body and a locking means for securing at least one surfer's foot to a surface of the surfboard may be provided without a fin. In this embodiment, the locking means is located in a gutter-shaped recess in the body being open from below, provided in a lower portion of the body. The locking means also comprises a low-pressure chamber, as well as an input chamber, an input chamber nozzle and an output pipe located sequentially. The nozzle is installed in the output pipe with a gap, and the low-pressure chamber is hermetically connected to a wall of the input chamber and a wall of the output pipe. The low-pressure chamber communicates with at least one opening provided in the surface of the surfboard by a suction pipe connected to the low-pressure chamber, to provide interaction with the surfer's foot.

In some embodiments, the surfboard according to either first or second embodiment is characterized in that the openings of the surfboard are equipped with push valves located so as to interact with the surfer's feet. Each push valve is spring-loaded or provided in a form of a resilient silicone membrane.

In the body of any of the surfboard embodiments, a receiver may be located, the receiver provided in communication with the low-pressure chamber and connected thereto by a central suction pipe. A check valve may be located in the central suction pipe between the receiver and the low-pressure chamber. The receiver may be equipped with a pressure sensor (herein also called an underpressure sensor) to indicate a level of pressure in the receiver.

The surfboard according to any of the embodiments may be equipped with a pressure regulator (herein also called an underpressure regulator) to adjust pressure in the low-pressure chamber and in the suction pipe. The output pipe may be provided with a funnel, in which the nozzle of the input chamber is located, while a gap is provided between the funnel and the nozzle.

The technical result is also obtained by a device for improving stability of surfer's position on the surfboard, the device comprising a locking means for securing at least one surfer's foot to a surface of the surfboard, the locking means connected to the surfboard, which device is characterized in that the locking means comprises a low-pressure chamber, as well as an input chamber, an input chamber nozzle and an output pipe located sequentially. The nozzle is installed in the output pipe with a gap, and the low-pressure chamber is hermetically connected to a wall of the input chamber and a wall of the output pipe. The low-pressure chamber communicates with at least one opening provided in the surface of the surfboard by a suction pipe connected to the low-pressure chamber, to provide interaction with the surfer's foot.

BRIEF DESCRIPTION OF DRAWINGS OF THE INVENTION

DESCRIPTION OF PREFERRED EMBODIMENTS OF THE INVENTION

Figure 1:
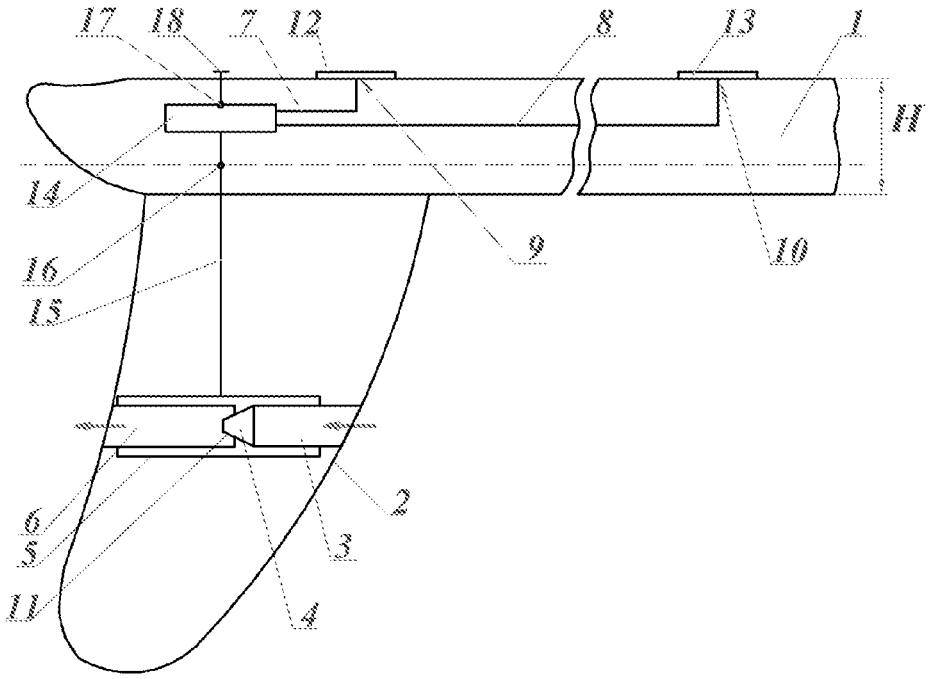
FIG. 1 shows a schematic view of a first embodiment of a surfboard having a device for improving stability of surfer's position, mounted in a fin of the surfboard.

A surfboard according to the first embodiment comprises a body 1 (FIG. 1) with a fin 2, wherein the body is equipped with a device for improving stability of surfer's position on the surfboard. The device is mounted in the fin 2 or on the fin 2. The device comprises an input chamber 3 having a conical nozzle 4 tapered to its end, a low-pressure chamber 5 and an output pipe 6, in which the conical nozzle 4 is partially inserted, all sequentially connected in a direction opposed to the surfboard movement direction. Walls of the low-pressure chamber 5 are hermetically connected to walls of the output pipe and the input chamber.

Figure 4:
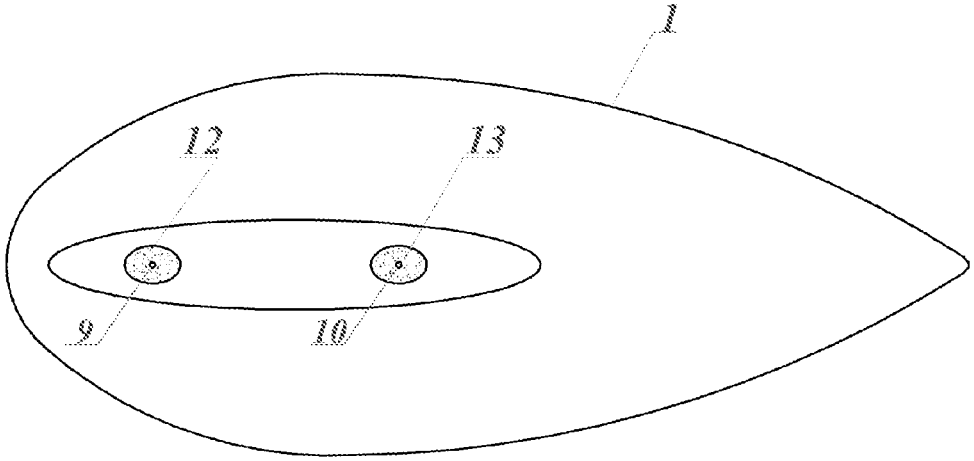
FIG. 4 shows a top view of a surfboard.
Figure 5:
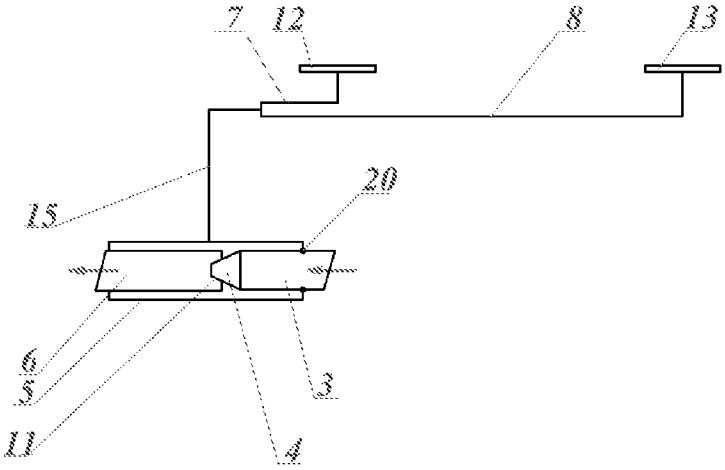
FIG. 5 shows a diagram of a device for improving stability of surfer's position (without a receiver and a check valve; the surfboard is not shown).

The low-pressure chamber 5 is a supporting structure, as it is connected to the surfboard body 1 and the indicated parts of the device. The indicated parts of the device are mounted in the chamber sequentially in the direction of the arrows, as shown in the figures. The device also comprises suction pipes 7 and 8 providing communication of the low-pressure chamber 5 with atmosphere. Ends of the suction pipes 7 and 8 are hermetically mounted in output openings 9 and 10 provided in the surfboard body 1 in an area of positioning the surfer's feet (FIG. 4), and the other ends of the suction pipes 7 and 8 communicate with the low-pressure chamber 5. Special channels inside the surfboard body 1 and inside the surfboard fin 2 may be used instead of the pipes 7 and 8.

A gap 11 is provided between the conical nozzle 4 and the output pipe 6. In order to increase or decrease the gap 11, the input chamber 3 with the conical nozzle 4 and the output pipe 6 are installed along the surfboard movably relative to each other and may be fixed in a predetermined operational position.

Shapes of the input chamber 3, the conical nozzle 4, the low-pressure chamber 5 and the output pipe 6 may be different. These elements are compact, depending on thickness H of the surfboard and height of the fin 2. In one embodiment, the input chamber 3, the conical nozzle 4, the low-pressure chamber 5 and the output pipe 6 are shaped as flat ovals, with their greater axes directed vertically and in parallel to the vertical axis of the fin 2. Preferably, the chamber 3, the nozzle 4, the output pipe 6 as well as the low-pressure chamber 5 are round-shaped in their cross-section.

In one embodiment of the surfboard, quick-detachable press valves 12 and 13 with footpads are secured to the top of the body above the body openings 9 and 10, while the footpads slightly project from the surfboard surface. Upon pressing the footpads of the valves and correspondingly the valves themselves, the valves open and the suction pipes 7 and 8 communicate with atmosphere. To ensure that, each valve footpad may be provided with a plurality of openings (not shown).

Other configurations of the valves are also possible. For example, in one embodiment, the valves are spring-loaded; in another embodiment, they are provided in a form of resilient silicone membranes, so the openings 9 and 10 open upon pressing the membranes. Each press valve is a normally closed valve; it opens only when the surfer's foot presses the valve or the valve footpad.

Configurations of the surfboard without the valves 12 and 13 are possible. In this embodiment, the constantly open openings 9 and 10 serve as valves to provide suction of surfer's feet to the surfboard. In this configuration, the openings 9 and 10 in the top surface of the body are open (with no valves in them) and located in an area of interaction between surfer's feet and the surfboard.

In any configuration of the surfboard, it comprises the openings 9 and 10, which may interact with surfer's feet either via the valves 12 and 13, or directly without any intermediate elements. One opening may be provided in the surfboard body instead of two openings.

In a configuration of the surfboard (without valves), a plurality of openings may be provided in the body; each opening may be formed by a separate group of smaller openings 9 and 10 for each sole of the surfer's feet, thus forming suction areas of different shapes for providing suction of the surfer's feet to the surfboard.

In a first embodiment of the surfboard (FIG. 1), the device for improving stability of surfer's position on the surfboard as disclosed in the above is located inside the hollow fin 2 between its walls and the device elements are shaped so as to fit the space between the fin walls. The surfboard may be equipped with a vacuum receiver 14 providing enough suction effect not only when the surfboard moves fast, but also at a slow speed and even when the surfboard stops. The vacuum receiver 14 is connected to the low-pressure chamber 5 by a central pipe 15, and it is connected to the openings 9 and 10 by the suction pipes 7 and 8. In addition, the surfboard may be equipped with a check valve 16 hampering motion of an air medium or a water medium in the direction from the low-pressure chamber 5 to the openings 9 and 10.

In order to indicate underpressure level in the device for improving stability of surfer's position, the surfboard may also be equipped with an underpressure sensor 17, which indications are output to a display (not shown) located on a surface of the surfboard. An underpressure regulator 18 may be mounted at the top side of the surfboard body 1. The underpressure regulator 18 communicates with the low-pressure chamber 5 and the suction pipes 7 and 8 by the pipe 15. The regulator 18 is a tap provided in communication with the check valve 16 and mounted flush in a recess of the surfboard. The regulator 18 is used for adjusting flow section of the suction pipe 15 by affecting the check valve 16.

Figure 2:
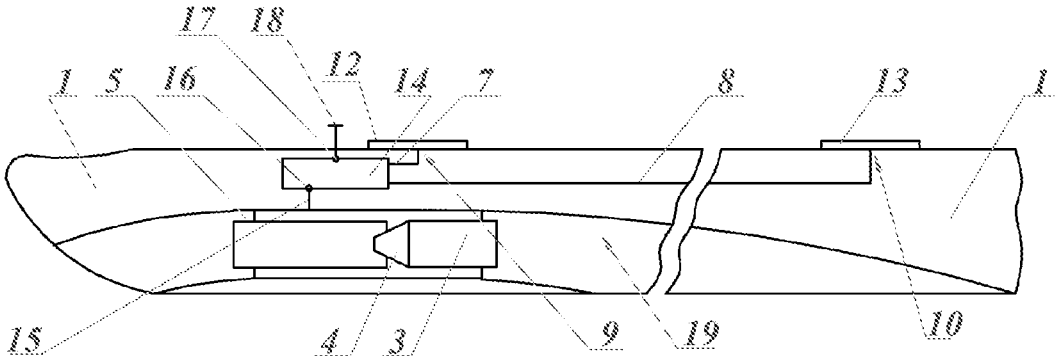
FIG. 2 shows a schematic view of a second embodiment of a surfboard without a fin, with a device for improving stability of surfer's position, mounted in the surfboard.

A second embodiment of the surfboard (FIG. 2) comprises all features of the first embodiment, except for the fin, which is absent in the second embodiment. In the second embodiment of the surfboard, the device for improving stability of surfer's position is mounted inside the surfboard. The second embodiment of the surfboard may have the same configuration features, as the first embodiment of the device.

In the second embodiment of the surfboard, a longitudinal recess 19 open from below is provided at a lower side of the surfboard to guide a water stream into the input chamber 3. The recess is provided in a form of a smooth longitudinal gutter located along the body 1 of the surfboard, and the device for improving stability of surfer's position is located within the recess 19 or after the recess in a rear portion of the surfboard.

Figure 6:
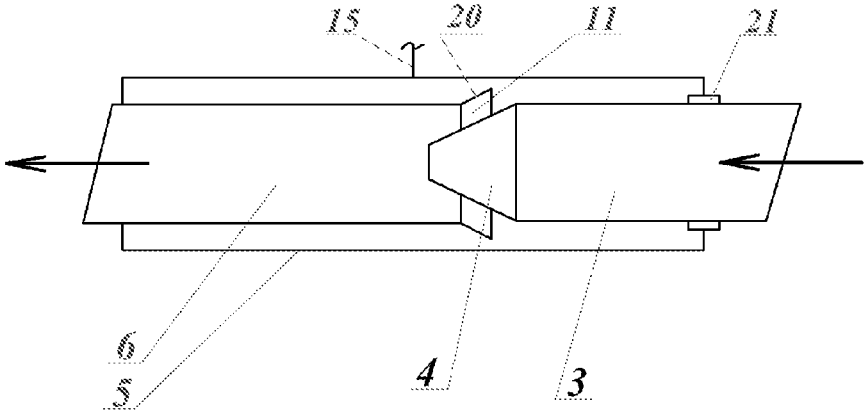
FIG. 6 shows an enlarged view of a lower portion of a device for improving stability of surfer's position.

The output pipe 6 has a funnel 20 at the side, where the conical nozzle 4 is located, the funnel 20 widening outwardly in the direction of the nozzle (FIG. 6). The funnel angle is preferably equal to the taper angle of the conical nozzle 4, so the gap 11 is located substantially in between the conical surfaces of the conical nozzle 4 and the conical funnel 20.

A screw mechanism for adjusting the gap 11 is provided in the device (FIG. 6). The mechanism has a threaded sleeve 21 secured to a wall of the low-pressure chamber 5. The sleeve has an inner thread, in which the outwardly threaded input chamber 3 is screwed.

Figure 3:
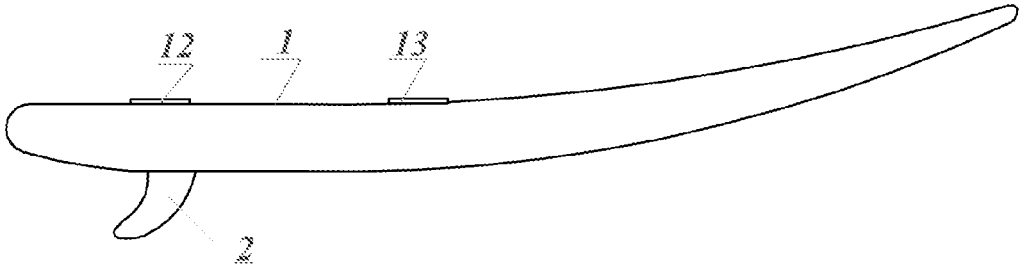
FIG. 3 shows a side view of a surfboard.

The surfboard operates as follows. When the surfboard moves in a water medium below its waterline shown as dashed line in FIG. 1, a water stream under pressure enters (according to the right to left arrow) the input chamber 3, the nozzle 4, the low-pressure chamber 5 and the output pipe 6. A fluid, i.e., air or water or a mixture of air and water is sucked in a natural manner from the low-pressure chamber 5 to the output pipe 6. Therefore, when the surfboard moves across a water surface, some underpressure is formed in the low-pressure chamber 5, and pressure in the suction pipe 15 is decreased below atmospheric level. Upon forming underpressure in the pipe 15, the check valve 16 opens (FIG. 2) and the fluid is drawn from the pipe 15 and the pipes 7 and 8. If the surfboard comprises the receiver 14 (FIG. 3), then the fluid is also drawn from the pipe 15, the receiver 14 and the pipes 7 and 8, wherein negative pressure of the fluid is formed.

When surfer's feet press the valves 12 and 13 having a plurality of small openings, they communicate with the openings 9 and 10 and suction of surfer's soles to surfaces of the valves 12 and 13 occurs, or suction of one of the surfer's soles to surface of one of the valves occurs.

If the valves 12 and 13 are not used, they are dismounted and in this case when one surfer's sole closes one opening or when two surfer's soles close two openings 9 and 10, the fluid sucks one sole or both soles of the surfer to the surfboard body 1. Thus, displacement of one or two feet of the surfer is hampered, so stability of surfer's position is improved.

When a surfboard according to the second embodiment (FIG. 2) moves in a water medium, incoming water enters the longitudinal gutter-shaped recess 19, then enters the input chamber 3, further passes the low-pressure chamber 5, and finally the water stream enters a rear portion of the recess 19. After that the above-indicated operational cycle of the surfboard having the device according to the second embodiment repeats, as it is recited in the previous embodiment.

During operation of the surfboard, underpressure occurs in the low-pressure chamber 5 in any embodiment of the surfboard, and air mixed with water particles is sucked from atmosphere via the valves 12 and 13 or via the openings 9 and 10, then it passes through the pipes 7 and 8, the receiver 14, the pipe 15, the check valve 16, the chamber 5 and enters the output pipe 6 via the gap 11. When feet press the valves 12 and 13, or when the openings 9 and 10 are closed by any portion of surfer's body, this portion is sucked to the working surface of the valve. Negative pressure in the low-pressure chamber 5 increases with increase in speed of the surfboard. The receiver 14 levels off a sharp change in pressure inside the device, so when underpressure of the fluid drops, a force of traction between the surfer's feet and the valves or openings in the surfboard body decreases gradually. If the device is used without the receiver 14 and the valve 16 (FIG. 1), hydraulic loss of the fluid underpressure caused by interaction with surfaces of the receiver 14 and the valve 16 is decreased. Using the valve 16 in the surfboard improves reliability of actuating the device at corresponding loss of the fluid underpressure.

The gap 11 is decreased by clockwise rotation of the input chamber 3 by a predetermined angle around the longitudinal axis of the chamber 3 relative to the fixed output pipe 6. The gap 11 is increased by rotation of the nozzle in the opposite direction. Adjustment of the gap allows selecting an optimal operational mode of the device, depending on the underpressure level in the low-pressure chamber 5.

The claimed group of technical solutions is novel in view of implementation of the method of providing traction between surfer's feet and a surface of a surfboard. The claimed technical solutions are of relatively simple design and they may be implemented using known technical means and existing materials. Use of these technical solutions is possible entirely owing to incoming stream of water, therefore they are ecological and economical, as no any electric power sources, fuel, etc. are needed.

The invention claimed is:

1. A method of improving stability of a surfer's position on a surfboard, said surfboard includes an anchoring means comprising a locking means, a suction chamber, and a pipe; said method comprising the steps of:

positioning at least one surfer's foot in the locking means located in a spot of contact between the at least one surfer's foot and the surfboard;

forming by the suction chamber a suction stream during movement of the surfboard upon water; and communicating the suction stream to the spot of contact between the at least one surfer's foot and the surfboard via the pipe; thereby forcing the least one surfer's foot to the surfboard by a force produced by the suction stream.

2. A surfboard comprising a body having a fin located in a rear portion of a lower side of the body, and a locking means for securing at least one surfer's foot to a surface of the surfboard, wherein:

the locking means comprises; a suction chamber, an input chamber, an input chamber nozzle and an output pipe located sequentially, and mounted on the fin or inside the fin;

wherein the input chamber nozzle is installed in the output pipe with a gap, and the suction chamber is hermetically connected to a wall of the input chamber and a wall of the output pipe; and wherein the suction low pressure chamber communicates with at least one opening provided in the surface of the surfboard by a suction pipe connected to the suction chamber, to provide interaction with the at least one surfer's foot.

3. The surfboard of claim 2, wherein the openings in the surfboard are equipped with press valves located so as to ensure interaction with the surfer's feet.

4. The surfboard of claim 3, wherein each of the press valves is spring-loaded.

5. The surfboard of claim 3, wherein each of the press valves is provided in a form of a resilient silicone membrane.

6. The surfboard of claim 2, wherein a receiver is located in the surfboard body, the receiver provided in communication with the suction chamber and connected thereto by a central suction pipe.

7. The surfboard of claim 6, wherein a check valve is located in the central suction pipe between the receiver and the suction chamber.

8. The surfboard of claim 6, wherein the receiver is equipped with a pressure sensor to indicate a level of pressure in the receiver.

9. The surfboard of claim 2, further equipped with a pressure regulator to adjust a pressure in the suction chamber and the suction pipe.

10. The surfboard of claim 2, wherein the output pipe has a funnel, in which the input chamber nozzle is located, while a gap is provided between the funnel and the nozzle.

11. A surfboard comprising a body and a locking means for securing at least one surfer's foot to a surface of the surfboard, wherein the locking means is located in a gutter-shaped recess open from below in a lower portion of the body, and comprises a suction chamber, an input chamber, an input chamber nozzle and an output pipe located sequentially, wherein the nozzle is installed in the output pipe with a gap, and the suction chamber is hermetically connected to a wall of the input chamber and a wall of the output pipe, wherein the suction chamber communicates with at least one opening provided in the surface of the surfboard by a suction pipe connected to the suction chamber, to provide interaction with the surfer's foot.

12. The surfboard of claim 11, wherein the openings in the surfboard are equipped with press valves located so as to ensure interaction with the surfer's feet.

13. The surfboard of claim 12, wherein each of the press valves is spring-loaded.

14. The surfboard of claim 12, wherein each of the press valves is provided in a form of a resilient silicone membrane.

15. The surfboard of claim 11, wherein a receiver is located in the surfboard body, the receiver provided in communication with the suction chamber and connected thereto by a central suction pipe.

16. The surfboard of claim 15, wherein a check valve is located in the central suction pipe between the receiver and the suction chamber.

17. The surfboard of claim 15, wherein the receiver is equipped with a pressure sensor to indicate a level of pressure in the receiver.

18. The surfboard of claim 11, further equipped with a pressure regulator to adjust a pressure in the suction chamber and the suction pipe.

19. The surfboard of claim 11, wherein the output pipe has a funnel, in which the input chamber nozzle is located, while a gap is provided between the funnel and the nozzle.

20. A device for improving stability of surfer's position on a surfboard, the device comprising a locking means for securing at least one surfer's foot to a surface of the surfboard, the locking means connected to the surfboard, wherein the locking means comprises a suction chamber, an input chamber, an input chamber nozzle and an output pipe located sequentially, wherein the nozzle is installed in the output pipe with a gap, and the suction chamber is hermetically connected to a wall of the input chamber and a wall of the output pipe, and wherein the suction chamber communicates with at least one opening provided in the surface of the surfboard by a suction pipe connected to the suction chamber, to provide interaction with the surfer's foot.

* * * * *